US008191196B2

(12) United States Patent
Aguilar et al.

(10) Patent No.: US 8,191,196 B2
(45) Date of Patent: Jun. 5, 2012

(54) MOUNTABLE SCRUBBING DEVICE

(76) Inventors: Sylvia Aguilar, Chicago, IL (US); Olivia Camacho, Chicago, IL (US)

( * ) Notice: Subject to any disclaimer, the term of this patent is extended or adjusted under 35 U.S.C. 154(b) by 712 days.

(21) Appl. No.: 12/274,796

(22) Filed: Nov. 20, 2008

(65) Prior Publication Data

US 2010/0122426 A1 May 20, 2010

(51) Int. Cl.
*A47K 7/02* (2006.01)

(52) U.S. Cl. ..... 15/210.1; 15/160; 15/244.1; 4/606; 601/136

(58) Field of Classification Search ..... 4/606; 601/136; 15/104.92, 160, 210.1, 244.1
See application file for complete search history.

(56) References Cited

U.S. PATENT DOCUMENTS

| | | | | |
|---|---|---|---|---|
| 825,379 | A * | 7/1906 | Clarke | 15/144.3 |
| 3,631,560 | A * | 1/1972 | Atkins | 15/146 |
| 3,750,226 | A | 8/1973 | Morgan | |
| 4,696,068 | A * | 9/1987 | Kenner | 4/606 |
| 5,175,896 | A | 1/1993 | Zamir | |
| 5,228,165 | A * | 7/1993 | Westberry et al. | 15/160 |
| 5,277,389 | A * | 1/1994 | Ballares et al. | 248/206.3 |
| 5,784,722 | A | 7/1998 | Ureta | |
| 5,822,824 | A | 10/1998 | Dion | |
| 5,933,909 | A | 8/1999 | Keating | |
| 6,370,722 | B1 * | 4/2002 | Duckworth | 15/104.92 |
| 6,568,029 | B1 * | 5/2003 | Letts | 15/106 |
| 6,647,564 | B1 | 11/2003 | Smith | |
| 2006/0117513 | A1 | 6/2006 | Ryman | |
| 2006/0121278 | A1 * | 6/2006 | Vinson et al. | 428/375 |
| 2006/0282966 | A1 * | 12/2006 | Popovsky et al. | 15/104.93 |
| 2009/0113616 | A1 * | 5/2009 | Daly, Sr. | 4/606 |

FOREIGN PATENT DOCUMENTS

WO WO95/27469 A1 10/1995

* cited by examiner

*Primary Examiner* — Mark Spisich
*Assistant Examiner* — Michael Jennings
(74) *Attorney, Agent, or Firm* — Jerry Haynes; Law Office of Jerry D. Haynes, P.A.

(57) ABSTRACT

A mountable scrubbing device comprises a support element comprising a rear surface and a front surface. Further, the mountable scrubbing device comprises a plurality of suction cups configured on the rear surface of the support element. The plurality of suction cups is adapted for detachably securing the support element on a flat surface. Furthermore, the mountable scrubbing device comprises a scrubbing element removably attached to the front surface of the support element. The scrubbing element is capable of scrubbing a posterior portion of an individual. Additionally, the mountable scrubbing device comprises a reversible hand scrubbing member detachably attached to the support element.

11 Claims, 6 Drawing Sheets

MOUNTABLE SCRUBBING DEVICE

FIELD OF THE INVENTION

The present invention generally relates to scrubbing devices, and more specifically, to a mountable scrubbing device for cleaning and scrubbing an individual's back and other body parts.

BACKGROUND OF THE INVENTION

While bathing or showering, many people encounter problems in cleaning and scrubbing their backs (i.e. posterior portion of a human body that extends from neck to an end portion of spine). More specifically, it is difficult for a person to reach an area between his/her shoulders and other portions of his/her back with his/her hands. Accordingly, people indulge into employing a number of contortions and combinations of contortions, and/or scrubbing devices to accomplish proper cleaning and scrubbing of their backs.

Suitable examples of conventional scrubbing devices include, but are not limited to, brushes with long handles and long straps; abrasive gloves; wash cloths; sponges disposed on long handles or strung to a rope. Although the aforementioned conventional scrubbing devices help in exfoliating and washing an individual's back, use thereof requires the individual to stretch in order to reach his/her back. Further, most of the conventional scrubbing devices either are nonadjustable and rigid. More specifically, many conventional scrubbing devices include a base with a fixed scrubbing element configured thereon. Such a fixation of the scrubbing element poses difficulty for an individual to effectively clean and scrub his/her back. Furthermore, a fixed scrubbing element may contribute to poor sanitary conditions in a bath or shower due to the difficulty in washing such a fixed scrubbing element. In addition, the conventional scrubbing devices are capable of effectively cleaning and scrubbing only a small area of an individual's back at one point of time. Moreover, a few of the conventional scrubbing devices are known to be excessively abrasive on skin of many individuals.

Additionally, some individuals may prefer to apply soap while bathing and scrubbing their backs. However, such individuals are usually incapable of obtaining soap in a quick and easy manner while bathing and/or scrubbing. Further, due to time constraints, some individuals also may desire to clean and scrub other body parts simultaneously while cleaning and scrubbing their backs.

Accordingly, there exists a need for a mountable scrubbing device for scrubbing an individual's back without any use of his/her hands. Further, there exists a need for a mountable scrubbing device that may easily and conveniently be used for applying soap and water thereon, prior to scrubbing an individual's back. Furthermore, there exists a need for a mountable scrubbing device which is abrasive enough to exfoliate yet not be excessively abrasive on skin of an individual. In addition, there exists a need for a mountable scrubbing device capable of holding soap for a quick and easy availability thereof to an individual while bathing and/or scrubbing. Moreover, there exists a need for a mountable scrubbing device for cleaning and scrubbing other body parts of an individual while cleaning and scrubbing the individual's back, in a convenient and easy manner.

SUMMARY OF THE INVENTION

In view of the foregoing disadvantages inherent in the prior art, the general purpose of the present invention is to provide a mountable scrubbing device, which includes all the advantages of the prior art, and overcomes the drawbacks inherent therein.

Accordingly, an object of the present invention is to provide a mountable scrubbing device for cleaning and scrubbing an individual's back, without any use of his/her hands.

Another object of the present invention is to provide a mountable scrubbing device that may easily and conveniently be used to apply soap and water thereon, prior to scrubbing an individual's back.

Another object of the present invention is to provide a mountable scrubbing device capable of holding soap for a quick and easy availability thereof to an individual while bathing and/or scrubbing.

Another object of the present invention is to provide a mountable scrubbing device which is abrasive enough to exfoliate, yet not excessively abrasive on skin of an individual.

In light of the above objects, the present invention discloses a mountable scrubbing device comprising a support element that includes a rear surface and a front surface. Further, the mountable scrubbing device comprises a plurality of suction cups configured on the rear surface of the support element. The plurality of suction cups is adapted for detachably securing the support element on a flat surface. Furthermore, the mountable scrubbing device comprises a scrubbing element removably attached to the front surface of the support element. The scrubbing element is capable of scrubbing a posterior portion of an individual. Additionally, the mountable scrubbing device comprises a reversible hand scrubbing member detachably attached to the support element.

This together with other embodiments of the present invention, along with the various features of novelty that characterize the present invention, is pointed out with particularity in the claims annexed hereto and form a part of this disclosure. For a better understanding of the present invention, its operating advantages, and the specific objects attained by its uses, reference should be made to the accompanying drawings and the descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, in which:

Like reference numerals refer to like parts throughout the description of the drawings.

DETAILED DESCRIPTION OF THE INVENTION

Figure 1B:
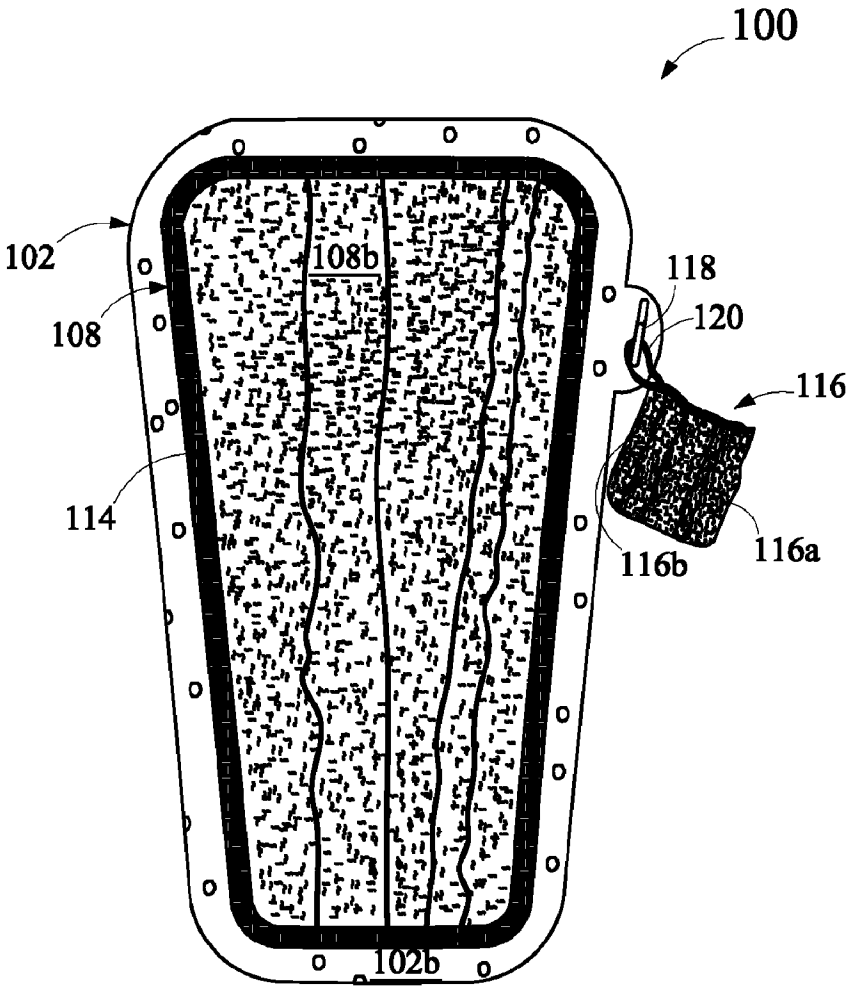
FIG. 1B depicts a front view of the mountable scrubbing device of FIG. 1A, according to an exemplary embodiment of the present invention.

The exemplary embodiments described herein detail for illustrative purposes are subject to many variations in structure and design. It should be emphasized, however, that the present invention is not limited to a particular mountable scrubbing device, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of terms, "including," or "comprising," and variations thereof herein is meant to encompass the items listed thereafter and equivalents thereof as well as additional items. Further, the terms "a" and "an" herein do not denote a limitation of quantity, but rather denote the presence of at least one of the referenced item.

Unless limited otherwise, the terms "attached," "secured," "adapted," and variations thereof herein are used broadly and encompass direct and indirect attachments and arrangements. The terms, "top," "bottom," "side," "first," "second," and the like, herein do not denote any order, elevation or importance, but rather are used to distinguish placement of one element over another.

The present invention relates to a mountable scrubbing device for cleaning and scrubbing an individual's back. The term, "back," as used herein refers to posterior portion of a human body that extends from neck to an end portion of spine (i.e., from shoulders to waistline). The mountable scrubbing device allows the individual to clean and scrub his/her back without any use of his/her hands. Further, soap and water may be applied onto the mountable scrubbing device prior to scrubbing the individual's back. Furthermore, the mountable scrubbing device is abrasive enough to exfoliate yet not excessively abrasive on skin of the individual. In addition, the mountable scrubbing device is capable of holding the soap, in the form of a soap bar for a quick and easy availability thereof while bathing and/or scrubbing. Additionally, the mountable scrubbing device may have a provision that enables cleaning and scrubbing of other body parts of the individual while the individual is cleaning and scrubbing his/her back.

The mountable scrubbing device of the present invention includes a support element including a rear surface and a front surface. Further, the mountable scrubbing device includes a plurality of suction cups configured on the rear surface of the support element. The plurality of suction cups is adapted for detachably securing the support element on a flat surface. Furthermore, the mountable scrubbing device includes a scrubbing element removably attached to the front surface of the support element. Additionally, the mountable scrubbing device includes a reversible hand scrubbing member detachably attached to the support element. The mountable scrubbing device of the present invention is explained in detail in conjunction with FIGS. 1-6.

Figure 1A:
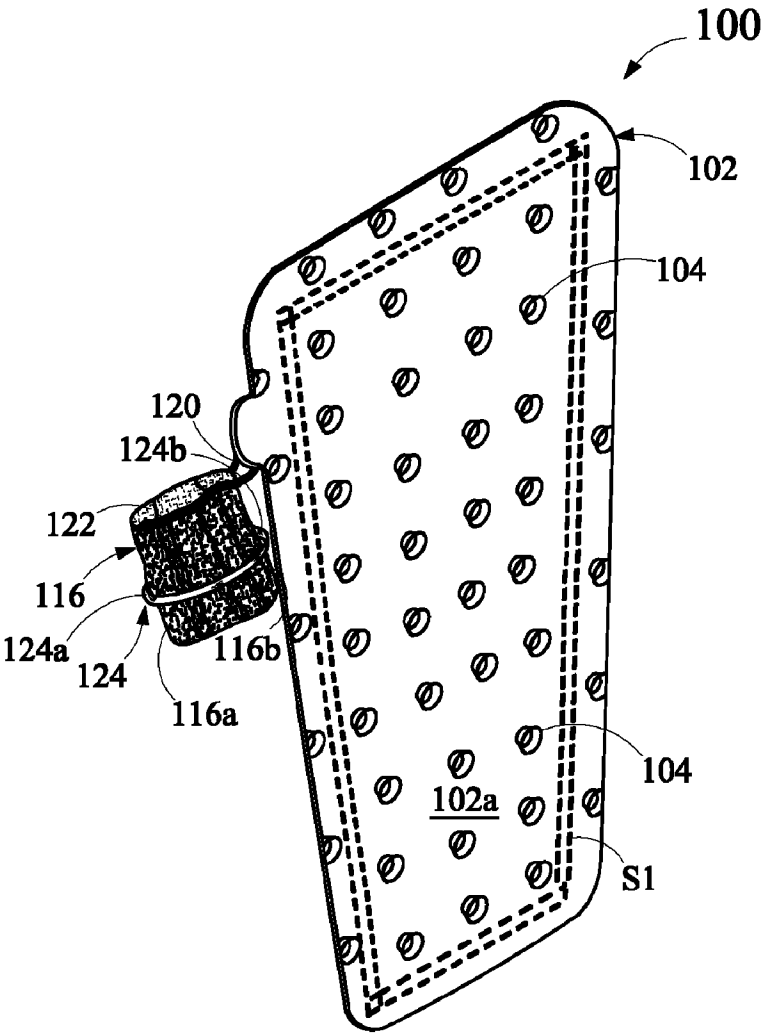
FIG. 1A depicts a perspective view of a mountable scrubbing device, according to an exemplary embodiment of the present invention.

FIG. 1A depicts a perspective view of a mountable scrubbing device 100, according to an exemplary embodiment of the present invention; and FIG. 1B depicts a front view of the mountable scrubbing device 100, according to an exemplary embodiment of the present invention.

Figure 2:
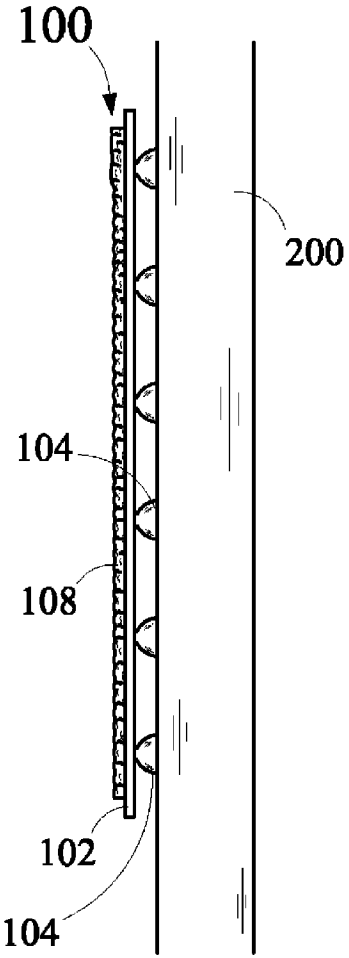
FIG. 2 depicts a side view of the mountable scrubbing device of FIGS. 1A and 1B when secured onto a flat surface, according to an exemplary embodiment of the present invention.
Figure 3:
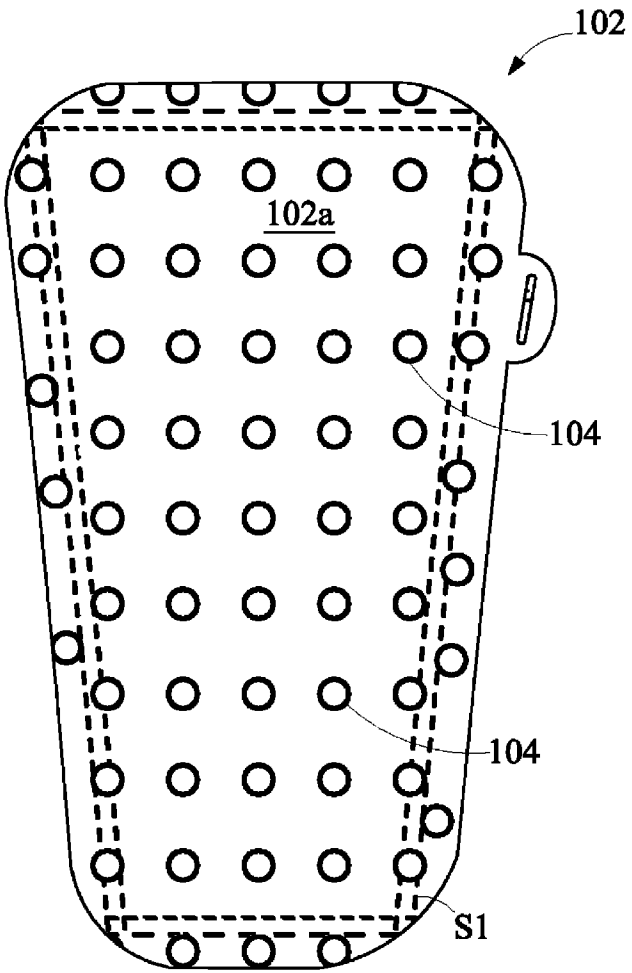
FIG. 3 depicts a rear view of a support element of the mountable scrubbing device of FIG. 1, according to an exemplary embodiment of the present invention.
Figure 4B:
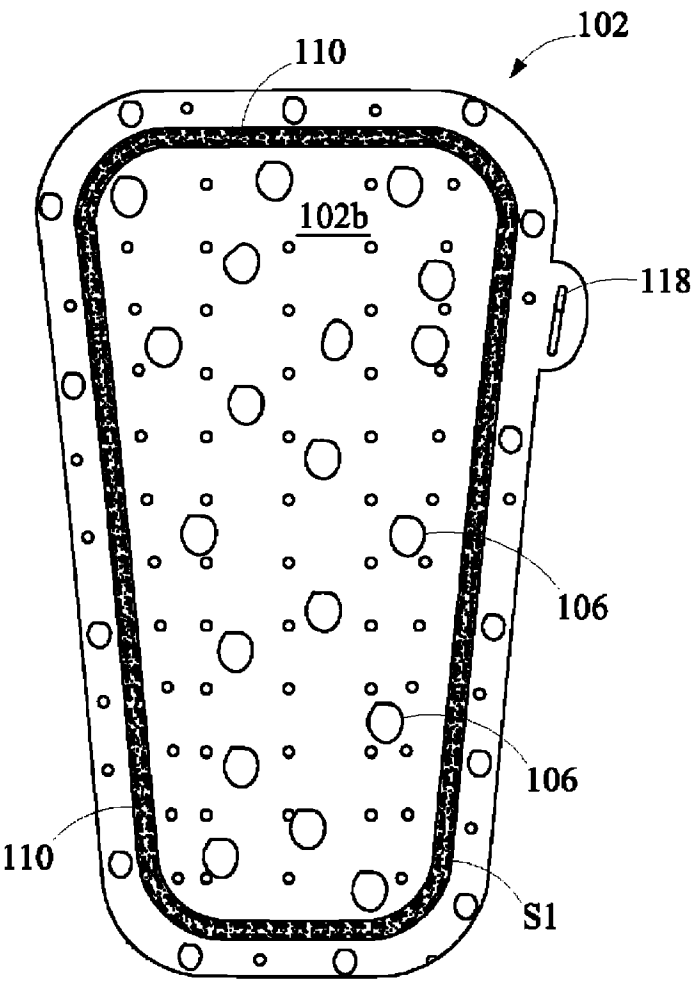
FIG. 4B depicts a front view of the support element of FIG. 3, according to another embodiment of the present invention.
Figure 4A:
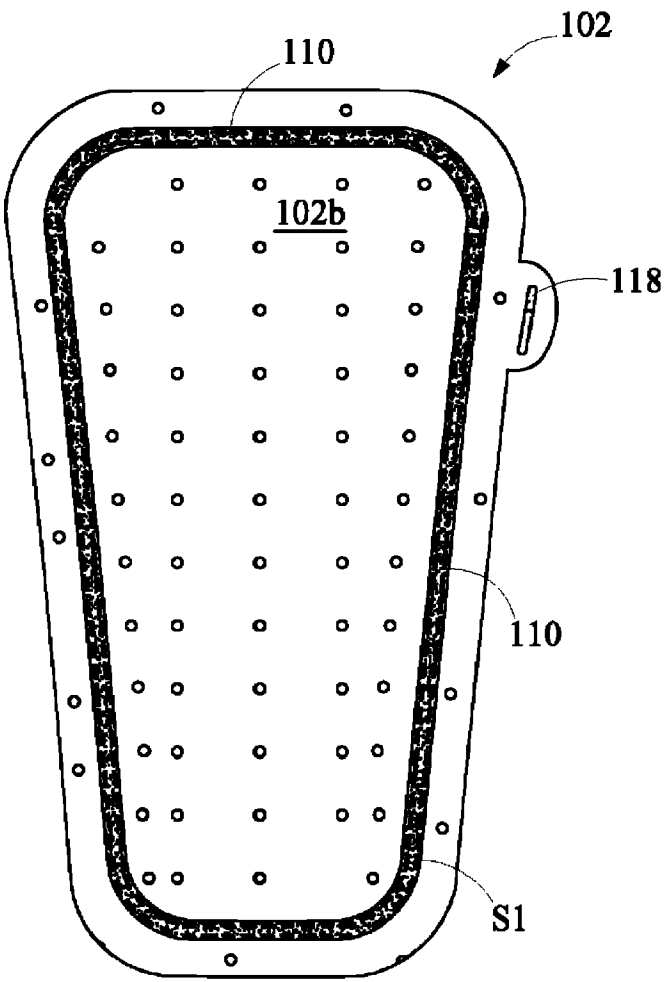
FIG. 4A depicts a front view of the support element of FIG. 3, according to an exemplary embodiment of the present invention.

The mountable scrubbing device 100 includes a support element 102 having a rear surface 102*a* (as shown in FIGS. 1A and 3) and a front surface 102*b* (as shown in FIGS. 4A and 4B). Further, the mountable scrubbing device 100 includes a plurality of suction cups 104 (hereinafter referred to as "suction cups 104") configured on the rear surface 102*a* of the support element 102 (as shown in FIGS. 1A, 1B, 2 and 3). The suction cups 104 are adapted for detachably securing the support element 102 on a flat surface 200 (as shown in FIG. 2) that represents a portion of a wall of a bathroom. Accordingly, the mountable scrubbing device 100 may be a wall-mountable scrubbing device. Further, the flat surface 200 may be a surface, which is either belonging to or located in the vicinity of a shower or a bathtub.

For the purpose of this description, the suction cups 104, as configured on the rear surface 102*a* of the support element 102, are spaced-apart at a distance from each other (as shown in FIG. 3). Further, the suction cups 104 may be either stitched or glued on the rear surface 102*a* of the support element 102. Alternatively, the suction cups 104 may be configured on the rear surface 102*a* of the support element 102 using any other mechanism known in the art for affixing suction cups, such as the suction cups 104, on to a surface, such as the rear surface 102*a*.

Each of the suction cups 104 may have a concave surface, which when placed against the flat surface 200 helps creating a small vacuum between the each of the suction cups 104 and the flat surface 200. The small vacuum holds the each of the suction cups 104 in place. Accordingly, it should be understood that the suction cups 104 are sufficiently pliable, such that the suction cups 104 may be pressed against the flat surface 200. Such a pressing may cause concave surfaces of the suction cups 104 to deform and flatten against the flat surface 200. Further, it should be understood that the suction cups 104 are made of a resilient material (such as a rubber material or a plastic material), which enables the suction cups 104 to return to original shapes thereof, after being removed from the flat surface 200. The suction cups 104 may be designed in any standard or custom shape and a dimension based on a manufacturer's preference.

With the help of suction cups 104, the mountable scrubbing device 100 may easily be secured at a location corresponding to a height of an individual. Further, the use of suction cups 104 ensures an easy affixation of the mountable scrubbing device 100 on any flat surface as per a user's convenience without the necessity of using other fixtures or parts. Furthermore, the mountable scrubbing device 100 may easily be affixed on any flat surface either vertically, horizontally or at any angle as desired by the user.

The support element 102 may have a shape and dimension as per a manufacturer's preference. For example, the support element 102 may be designed to have a shape such as a rectangular shape, a trapezoidal shape, and such other shapes. Further, the support element 102 may have a length of about 20½ inches ("). Furthermore, the support element 102 may have a width of about 11½" from a top portion (not numbered) thereof, which tapers down to about 8½" at a bottom portion (not numbered) thereof. It should be understood that such a dimension of the support element 102 ensures cleaning and scrubbing of an individual's back in a proper manner.

In addition, the support element 102 is composed of rubber. More specifically, the support element 102 is a rubber mat.

Use of rubber for manufacturing the support element 102 helps providing characteristics such as softness and malleability to the support element 102. Said properties of the support element 102 allow for conformation of the mountable scrubbing device 100 along contours of a back of an individual, when the individual presses the support member 102 against a flat surface, such as the flat surface 200.

In an embodiment of the present invention, the support element 102 may be designed to include a plurality of projections 106 (hereinafter referred to as "projections 106") on the front surface 102*b* (as shown in FIG. 4B). The projections 106 render the support element 102 to have a specific texture that may enable the support element 102 to be slightly abrasive. Further, the projections 106 may be provided to have an enhanced scrubbing and/or massaging effect. The projections 106 may have either a defined shape (such as a circular shape) or an irregular shape.

Figure 5:
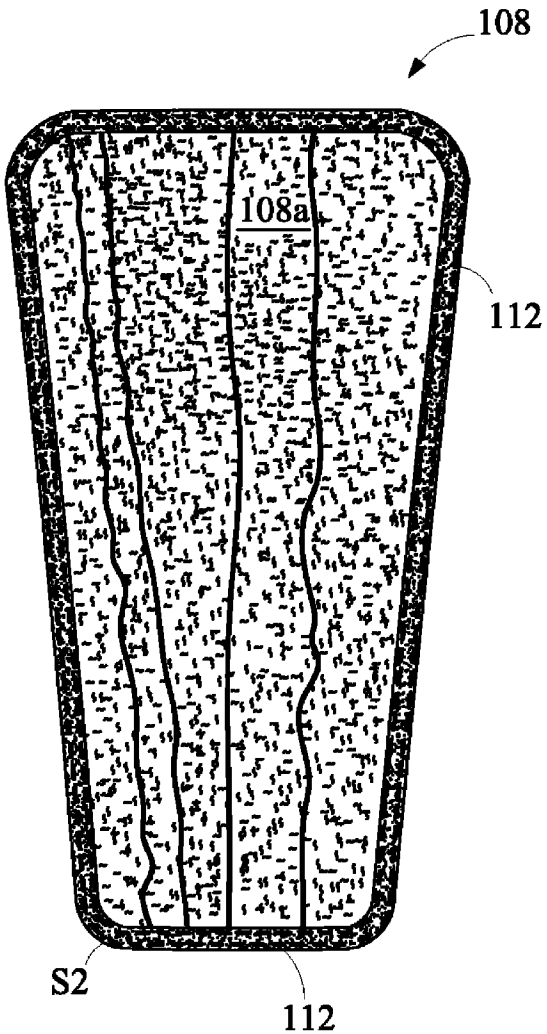
FIG. 5 depicts a rear view of a scrubbing element for removably attaching to the support element of FIGS. 3, 4A and 4B, according to an exemplary embodiment of the present invention.
Figure 6:
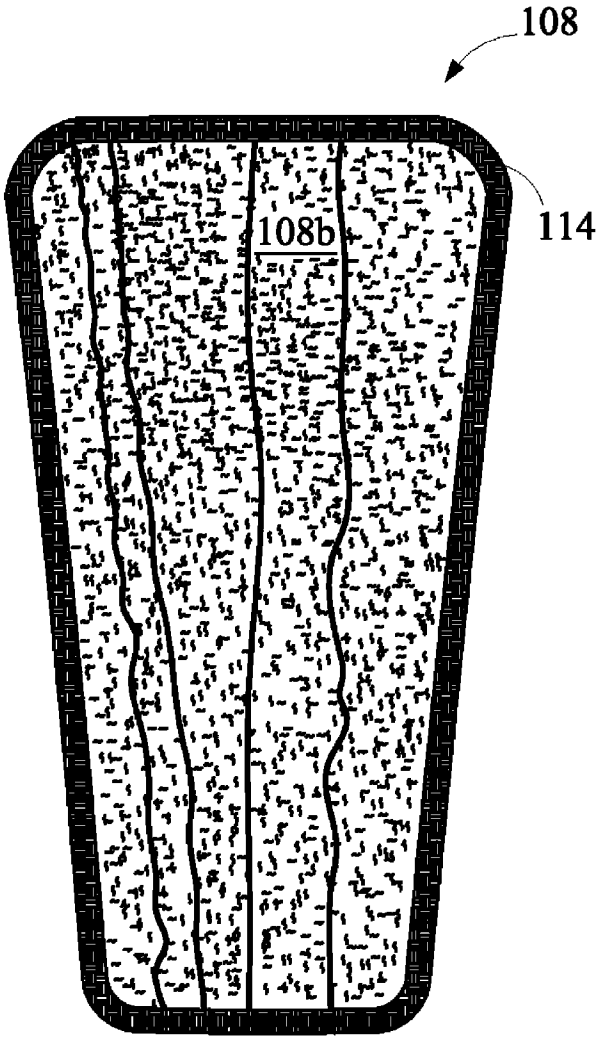
FIG. 6 depicts a front view of the scrubbing element of FIG. 5, according to an exemplary embodiment of the present invention.

Further, the mountable scrubbing device 100 includes a scrubbing element 108 removably attached to the front surface 102*b* of the support element 102 (as shown in FIGS. 1B and 2). The scrubbing element 108 is capable of scrubbing a posterior portion of an individual. The term, "posterior portion," as used herein refers to back of an individual's body extending from neck to an end portion of spine (i.e., from shoulders to waistline) thereof. The mountable scrubbing device 100 allows the individual to clean and scrub his/her back without any use of his/her hands. The scrubbing element 108 includes a rear surface 108*a* (as shown in FIG. 5) and a front surface 108*b* (as shown in FIG. 6).

Further, the mountable scrubbing device 100 includes a plurality of loop shaped elements (hereinafter referred to as "loop elements") arranged in the form of a plurality of first strips 110 (hereinafter referred to as "first strips 110") configured on the front surface 102*b* of the support element 102. More specifically, four of such first strips 110 may be affixed onto the front surface 102*b* of the support element 102. Further, the first strips 110 may be stitched onto the front surface 102*b* of the support element 102. Such stitching is represented by stitches "S1" in FIGS. 1A, 3, 4A and 4B. Alternately, the first strips 110 may be affixed onto the front surface 102*b* using adhesives. It should be apparent that the first strips 110 may be affixed onto the front surface 102*b* using any other mechanism known in the art. A suitable example of the first strips 110 may be strips made of loop fasteners.

The first strips 110 may be affixed onto or in proximity to edges or periphery (not numbered) of the front surface 102*b* of the support element 102. For the purpose of this description, the first strips 110 may be affixed in proximity to the periphery of the front surface 102*b* of the support element 102 (as shown in FIGS. 1A, 3, 4A and 4B).

Furthermore, the mountable scrubbing device 100 includes a plurality of hook shaped elements (hereinafter referred to as "hook elements") arranged in the form of a plurality of second strips 112 (hereinafter referred to as "second strips 112") configured on the rear surface 108*a* of the scrubbing element 108. The second strips 112 may be affixed onto or in proximity to edges or periphery (not numbered) of the rear surface 108*a* of the scrubbing element 108. For the purpose of this description, the second strips 112 may be affixed onto the periphery of the rear surface 108*a* of the scrubbing element 108 (as shown in FIG. 5). Further, four of such second strips 112 are affixed onto the rear surface 108*a* of the scrubbing element 108. Further, the second strips 112 may be stitched onto the rear surface 108*a* of the scrubbing element 108. Such stitching is represented by stitches "S2" in FIG. 5. Alternately, the second strips 112 may be affixed onto the rear surface 108*a* using adhesives. It should be apparent that the second strips 112 may be affixed onto the rear surface 108*a* using any other mechanism known in the art. A suitable example of second strips 112 may be strips made of hook fasteners.

The loop elements arranged in the form of the first strips 110 are capable of receiving or engaging with the hook elements arranged in the form of the second strips 112 to allow for the removable attachment of the scrubbing element 108 with the front surface 102*b* of the support element 102. It should be understood that the first strips 110 are affixed to proximal portions of the periphery of the front surface 102*b* of the support element 102 to engage with corresponding second strips 112 affixed onto the periphery of the rear surface 108*a* of the scrubbing element 108. With the help of such an engagement of the loop elements and the hook elements, the scrubbing element 108 may be stretched easily and tightly over the front surface 102*b* of the support element 102. Further, the removable attachment of the scrubbing element 108 to the support element 102 permits easy removal of the scrubbing element 108 for washing purposes.

The above described arrangement of the hook elements and the loop elements should not be construed as a limitation of the present invention. Accordingly, it should be understood that the hook elements may be arranged in the form of the first strips 110 for configuring on the front surface 102*b* of the support element 102, and the loop elements may be arranged in the form of second strips 112 for configuring on the rear surface 108*a* of the scrubbing element 108.

The scrubbing element 108 may have a standard or a custom shape and dimension as per a manufacturer's preference. The scrubbing element 108 may have a rectangular shape, a trapezoidal shape, a square shape or any other shape. Further, the scrubbing element 108 may have a length of about 20". Furthermore, the scrubbing element 108 may have a width of about 10½" from a top portion (not numbered) thereof, which tapers down to about 7½" at a bottom portion (not numbered) thereof. It may be understood that the scrubbing element 108 is smaller than the support element 102. Based on the dimensions of the scrubbing element 108 and the support element 102, it should be understood that the mountable scrubbing device 100 may have a size corresponding to an average size of an individual's back. However, it should be understood that the lengths of the scrubbing element 108 and the support element 102 may be adjusted in order to easily and conveniently clean and scrub a posterior portion of the individual's body that extends from neck to an area below a waistline of the individual.

The scrubbing element 108 is composed of a fibrous scrubbing material. A suitable example of the fibrous scrubbing material is loofah. The fibrous scrubbing material has a texture with natural ridges on at least one of the rear surface 108*a* and the front surface 108*b* (as shown in FIGS. 5 and 6). Such natural ridges usually contour with the rear surface 108*a* of the scrubbing material when a measured piece is cut from whole loofah. In an alternate embodiment of the present invention, the scrubbing element 108 is a brush.

The scrubbing element 108 may also include a strip 114 either pinned, glued or sewed along the perimeter of the front surface 108*b*, for providing an aesthetic appearance to the scrubbing element 108 (as shown in FIGS. 1B and 6). Such strip 114 may be made of a material such as a fabric material, a polymeric material and the like.

Moreover, the mountable scrubbing device 100 includes a reversible hand scrubbing member 116 detachably attached to the support element 102. Accordingly, the mountable scrubbing device 100 further comprises a fastening element 118 configured on a portion (not numbered) of the support element 102 for detachably attaching the reversible hand scrubbing member 116 to the support element 102 (as shown in FIG. 4). More specifically, the fastening element 118 is configured on the portion, which is unoccupied by the scrubbing element 108. Such portion may be a portion extending from the periphery of the support element 102 (as shown in FIGS. 1B, 4A and 4B).

The fastening element 118 is a hook affixed to the support element 102. More specifically, the fastening element 118 is a rubber hook. The fastening element 118 may be affixed to the support element 102 using a mechanism known in art, such as adhesives. The reversible hand scrubbing member 116 includes a string 120 to engage with the fastening element 118 (as shown in FIG. 1B). The string 120 may be attached to a portion (not numbered) of perimeter (not numbered) of the reversible hand scrubbing member 116 and may extend from an end portion (not numbered) thereof while forming a loop-shaped structure (not numbered). The loop-shaped structure is capable of engaging with the fastening element 118 to allow for the detachable attachment of the reversible hand scrubbing member 116 with the support element 102.

Alternatively, the reversible hand scrubbing member 116 may include a suction cup (not shown) capable of establishing the detachable attachment of the reversible hand scrubbing member 116 with the support element 102.

The reversible hand scrubbing member 116 is composed of a fibrous scrubbing material. A suitable example of the fibrous scrubbing material for manufacturing the reversible hand scrubbing member 116 is loofah. More specifically, the reversible hand scrubbing member 116 is composed of two pieces of the fibrous scrubbing material attached with each other in order to form an enclosure 122 (i.e. a pocket; as shown in FIG. 1A) there within for holding a soap bar. It should be understood that the two pieces of the fibrous scrubbing material should be attached from edges (not numbered) thereof while keeping one side open or unattached to allow insertion of the soap bar there through into the enclosure 122. Such a configuration of the reversible hand scrubbing member 116 allows for a quick and easy availability of the soap bar to an individual while bathing and/or scrubbing.

The two pieces of the fibrous scrubbing material may be glued together from the edges thereof in order to form the enclosure 122 there within. Alternately, the two pieces may be sewn together from edges thereof, leaving one side open to form the enclosure 122 there within.

Further, the reversible hand scrubbing member 116 may have a standard or a custom shape and dimension as per a manufacturer's preference. More specifically, the reversible hand scrubbing member 116 may be designed to have a square, a rectangular, an oval or a trapezoidal shape. Furthermore, the reversible hand scrubbing member 116 may have a size corresponding to size of an individual's hand.

The reversible hand scrubbing member 116 includes an elastic band 124 with end portions 124*a* and 124*b* attached on side portions 116*a* and 116*b* thereof (as shown in FIG. 1A). More specifically, the end portion 124*a* is attached to a middle section of the side portion 116*a* of the reversible hand scrubbing member 116. Similarly, the end portion 124*b* is attached to a middle section of the side portion 116*b* of the reversible hand scrubbing member 116. The elastic band 124 being a stretchable band aids in securing, positioning and holding an individual's hand onto the reversible hand scrubbing member 116 by providing a suitable fitting of the individual's hand when placed between the elastic band 124 and the reversible hand scrubbing member 116. Further, the elastic band 124 may easily be flipped over in order to be positioned on opposite side (not shown) of the reversible hand scrubbing member 116 to allow the individual to use the reversible hand scrubbing member 116 from the opposite side, as and when desired. Accordingly, it should be understood that the phrase "reversible hand scrubbing member," as used herein, refers to a hand scrubbing member that may be held in or worn on an individual's hand and may be used from any side thereof for scrubbing purposes. More specifically, the reversible hand scrubbing member 116 may be used to scrub other parts of an individual's body while the individual uses the scrubbing element 108 for cleaning and scrubbing his/her back.

The elastic band 124 may be attached to the side portions 116*a* and 116*b* of the reversible hand scrubbing member 116 using adhesives. Alternately, the elastic band 124 may be stitched onto the side portions 116*a* and 116*b*. It should be apparent to a person skilled in the art that the elastic band 124 may be attached to the side portions 116*a* and 116*b* of the reversible hand scrubbing member 116 using a mechanism known in the art.

In use, the support element 102 of the mountable scrubbing device 100 may be detachably secured onto the flat surface 200 with the help of the suction cups 104. Subsequently, the scrubbing element 108 may be attached to the front surface 102*b* of the support element 102 using the hook and loop elements. Further, the soap bar held in the reversible hand scrubbing member 116 may be obtained. Water and the soap bar may then be applied to the scrubbing element 108. Subsequently, an individual may move his/her body either in an up-and-down direction, or side-to-side direction, or a combination of both, in order to clean and scrub his/her back. Simultaneously, the individual may also use the reversible hand scrubbing member 116 for scrubbing any other body part as per his/her desire. After a single or multiple use of the mountable scrubbing device 100, the scrubbing element 108 may be removed from the support element 102. Subsequently, the scrubbing element 108 may be washed for sanitary purposes.

The present invention provides a mountable scrubbing device, such as the scrubbing device 100, which includes a support element having a rear surface and a front surface; a plurality of suction cups configured on the rear surface of the support element for detachably securing the support element on a flat surface; and a scrubbing element removably attached to the front surface of the support element. The use of the mountable scrubbing device enables an individual to clean and scrub his/her back without using hands thereof. More specifically, the mountable scrubbing device serves as an important scrubbing tool for individuals with oily posterior portions. Further, the mountable scrubbing device includes a reversible hand scrubbing member detachably attached to the support element for cleaning and scrubbing other parts of an individual's body.

The removable attachment of the scrubbing element onto the support element allows for an easy and convenient way of removing the scrubbing element in order to apply soap and water thereon, prior to scrubbing an individual's back. Further, the materials used for manufacturing different components of the mountable scrubbing device allow the mountable scrubbing device to be abrasive enough to exfoliate yet not be excessively abrasive on skin of the individual.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and thereby enable others skilled in the art to best utilize the invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A mountable scrubbing device comprising:

a support element comprising a rear surface and a front surface;

a plurality of suction cups configured on the rear surface of the support element, the plurality of suction cups adapted for detachably securing the support element on a flat surface;

a scrubbing element removably attached to the front surface of the support element, the scrubbing element capable of scrubbing a posterior portion of an individual;

a plurality of projections on the front surface of the support element;

a reversible hand scrubbing member detachably attached to the support element;

a plurality of hook shaped elements in the form of a plurality of second strips configured on the periphery edge of the scrubbing element, and a plurality of loop shaped elements in the form of a plurality of first strips configured on the periphery edge of front surface of the support element for receiving the plurality of hook shaped elements, for removably attaching the scrubbing element to the front surface of the support element.

2. The mountable scrubbing device of claim 1, further comprising a fastening element configured on a portion of the support element for detachably attaching the reversible hand scrubbing member to the support element.

3. The mountable scrubbing device of claim 1, wherein the support element is composed of rubber.

4. The mountable scrubbing device of claim 3, wherein the support element is a rubber mat.

5. The mountable scrubbing device of claim 1, wherein the scrubbing element is composed of a fibrous scrubbing material.

6. The mountable scrubbing device of claim 5, wherein the fibrous scrubbing material is loofah.

7. The mountable scrubbing device of claim 1 is a wall-mountable scrubbing device.

8. The mountable scrubbing device of claim 1, wherein the reversible hand scrubbing member comprises an enclosure for holding a soap bar.

9. The mountable scrubbing device of claim 1, wherein the reversible hand scrubbing member is composed of a fibrous scrubbing material.

10. The mountable scrubbing device of claim 9, wherein the fibrous scrubbing material is loofah.

11. The mountable scrubbing device of claim 1, wherein the posterior portion extends from neck to an end portion of spine of the individual.

* * * * *